US010720174B2

(12) United States Patent
Ikeshita et al.

(10) Patent No.: US 10,720,174 B2
(45) Date of Patent: Jul. 21, 2020

(54) SOUND SOURCE SEPARATION METHOD AND SOUND SOURCE SEPARATION APPARATUS

(71) Applicant: HITACHI, LTD., Tokyo (JP)

(72) Inventors: Rintaro Ikeshita, Tokyo (JP); Yohei Kawaguchi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 16/118,986

(22) Filed: Aug. 31, 2018

(65) Prior Publication Data

US 2019/0115043 A1 Apr. 18, 2019

(30) Foreign Application Priority Data

Oct. 16, 2017 (JP) ..... 2017-200108

(51) Int. Cl.
*G10L 21/0308* (2013.01)
*G10L 21/0388* (2013.01)

(52) U.S. Cl.
CPC ..... *G10L 21/0308* (2013.01); *G10L 21/0388* (2013.01)

(58) Field of Classification Search
USPC ..... 381/56, 61, 71.14, 94.3, 98, 372, 402
See application file for complete search history.

(56) References Cited

U.S. PATENT DOCUMENTS

2014/0058736 A1* 2/2014 Taniguchi ..... G10L 19/00 704/500
2015/0199954 A1* 7/2015 Ukai ..... G10K 11/175 381/73.1

FOREIGN PATENT DOCUMENTS

JP 2014-041308 A 3/2014

OTHER PUBLICATIONS

NPL document, IEEE/ACM Transactions on Audio, Speech. and Language Processing, vol. 24. No. 9, Sep. 2016.*
Kitamura et al. "Determined Blind Source Separation Unifying Independent Vector Analysis and Nonnegative Matrix Factorization," IEEE/ACM Transactions on Audio, Speech, and Language Processing, vol. 24, No. 9, pp. 1626-1641, Sep. 2016.

* cited by examiner

*Primary Examiner* — Yosef K Laekemariam
(74) *Attorney, Agent, or Firm* — Volpe and Koenig, P.C.

(57) ABSTRACT

There is provided a sound source separation method of carrying out sound source separation of an audio signal inputted from an input device by using a modeled sound source distribution, by an information processing apparatus provided with a processing device, a storage device, the input device, and an output device. In this method, as a condition followed by the model, sound sources are independent of one another, powers which the sound sources have are modeled for each of frequency bands obtained through band division, a relationship among the powers for the frequency bands different from each other is modeled by nonnegative matrix factorization, and components obtained through the division of the sound source follow a complex normal distribution.

14 Claims, 9 Drawing Sheets

SOUND SOURCE SEPARATION METHOD AND SOUND SOURCE SEPARATION APPARATUS

BACKGROUND OF THE INVENTION

1. Field of the Invention

The present invention relates to a technology pertaining to sound source separation, and more particularly to a sound source separation method and a sound source separation apparatus each of which has high separation performance.

2. Description of the Related Art

A blind sound source separation technology means a signal processing technology for estimating individual original signals before mixture, under a situation in which information associated with a sound source mixing process or the like is unknown, from only an observed signal obtained through mixture of sound source signals from a plurality of sound sources. In recent years, the research of an overdetermined blind sound source separation technology for carrying out sound source separation under a condition in which the number of microphones is equal to or larger than the number of sound sources has been actively progressed.

"The independent component analysis" which has been known from the past is a technology for carrying out the sound source separation on the assumption that the sound sources existing in the environment are statistically independent of one another. In general, in the independent component analysis, microphone observed signals are transformed into a time-frequency domain, and a separation filter is estimated every frequency band so that separation signals become statistically independent of one another. In order to carry out the estimation of the separation filter every frequency band, in the independent component analysis, for obtaining the final sound source separation results, the separation results of the frequency bands need to be rearranged in order of the sound sources. This problem is called a permutation problem, and is known as a problem which is not easy to solve.

"An independent vector analysis (IVA)" attracts attention as the technique capable of solving the permutation problem. In the independent vector analysis, a sound source vector which is obtained by bundling the time-frequency components of the sound sources over the entire frequency band is considered for the sound sources, and the separation filter is estimated so that the sound source vectors become independent of one another. This technology is disclosed in JP-2014-41308-A. In the independent vector analysis, in general, since it was assumed that the sound source vectors follow a spherically symmetric probability distribution, the sound source separation was carried out without modeling a structure of directions of the frequencies which the sound source has.

"An independent low-rank matrix analysis (ILRMA) is a technology for modeling sound source vectors in the independent vector analysis by using "Nonnegative Matrix Factorization (NMF)," thereby carrying out the sound source separation. This technology is disclosed in "D. Kitamura, N. Ono, H. Sawada, H. Kameoka, and H. Saruwatari, "Determined Blind Source Separation Unifying Independent Vector Analysis and Nonnegative Matrix Factorization," IEEE/ACM Transactions on Audio, Speech, and Language Processing, vol. 24, no. 9, pp. 1626-1641, September, 2016

(hereinafter referred to as "the non-patent document"). The independent low-rank matrix analysis, similarly to the independent vector analysis, is a technology which can avoid the permutation problem. Moreover, the sound source vector is modeled by using NMF, thereby enabling the sound source separation to be carried out by utilizing a structure of the directions of frequencies which the sound source has.

SUMMARY OF THE INVENTION

Since the independent vector analysis disclosed in JP-2014-41308-A ignored the structure of the directions of the frequencies which the audio signal has, there is a restriction in terms of the accuracy. The independent low-rank matrix analysis disclosed in the non-patent document models the sound source vectors by using NMF, thereby enabling the sound source separation to be carried out by utilizing co-occurrence information associated with the remarkable frequency components in the audio signal. However, with the modeling by using NMF, since the high-order correlation among the neighborhood frequencies which the audio signal or the like has cannot be utilized, there is a problem that the sound source separation performance is low for the audio signal or the like which cannot be grasped by only the co-occurrence of the frequency components.

In the light of the foregoing, the present invention has been made in order to solve the problems described above, and is therefore an object of the present invention to provide a sound source separation method and a sound source separation apparatus each of which can have high separation performance.

In order to solve the problems described above, according to an embodiment of the present invention, there is provided a sound source separation method of carrying out sound source separation of an audio signal inputted from an input device by using a modeled sound source distribution, by an information processing apparatus provided with a processing device, a storage device, the input device, and an output device. In this method, as a condition followed by the model, sound sources are independent of one another, powers which the sound sources have are modeled for each of frequency bands obtained through band division, a relationship among the powers for the frequency bands different from each other is modeled by nonnegative matrix factorization, and components obtained through division of the sound source follow a complex normal distribution.

According to another embodiment of the present invention, there is provided a sound source separation apparatus provided with a processing device, a storage device, an input device, and an output device, the sound source separation apparatus serving to carry out sound source separation of an audio signal inputted from an input device by using a modeled sound source distribution. In this apparatus, as a condition followed by the model, sound sources are independent of one another, powers which the sound sources have are each modeled every frequency band obtained through band division, a relationship among the powers for the different frequency bands is modeled by nonnegative matrix factorization, and components obtained through the division of the sound source follow a complex normal distribution.

According to the present invention, it is possible to provide the sound source separation method and the sound source apparatus each of which has the high-separation performance.

DESCRIPTION OF THE PREFERRED EMBODIMENTS

Figure 1:
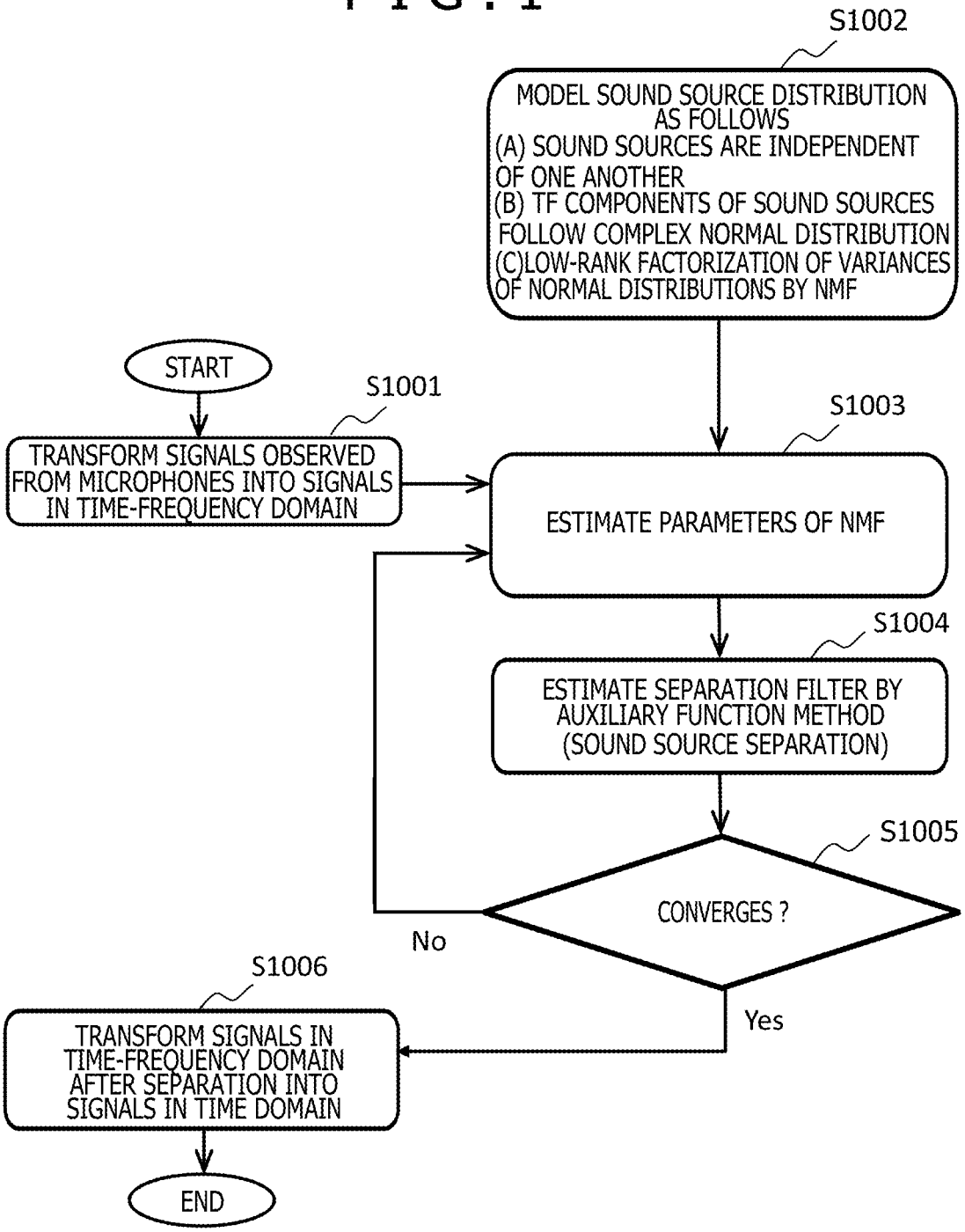
FIG. 1 is a conceptual flow chart of a comparative example.

Hereinafter, embodiments of the present invention will be described in detail with reference to the accompanying drawings. However, the present invention is not interpreted so as to be limited to description contents of the embodiments which will be depicted below. It is readily understood by a person skilled in the art that the concrete constitutions can be made without departing from the idea or the sprite of the present invention.

In the constituents of the present invention which will be described below, the same portions or the similar reference numerals are used in the same portions or portions having the similar functions, so as to be common to the drawings and a repeated description is omitted here in some cases.

In the case where there is a plurality of constituent elements having the same or similar functions, a description is given with the same reference numerals being assigned different suffixes, in some cases. However, in the case where there is no need for distinguishing a plurality of constituent elements from one another, a description may be given with suffixes being omitted.

The description such as "first," "second," or "third" in this specification is given in order to identify the constituent elements, and does not necessarily limit the number, the order or the contents thereof. In addition, the numbers for identification of the constituent elements are used every context, and the numbers used in one context do not necessarily indicate the same constitution in any order context. In addition, a constituent element which is identified with a certain number does not impede to serve a function of a constituent element as well identified with any other number.

Prior to a description of the detailed description, a description will now be given by comparing the characteristics of examples with the independent low-rank matrix analysis disclosed in the non-patent document.

FIG. 1 is a conceptual flow chart of a comparative example produced by the present inventors in order to describe sound source separation using the independent low-rank matrix analysis. In a sound source separation apparatus, normally, signals observed with a plurality of microphones are transformed into signals in domains of time and frequencies by, for example, Fourier transform (processing S1001). Such signals, for example, can be visually displayed in a graphic in which an area having a large sound power (energy of a sound per unit time) is depicted darker (or brighter) on a plane in which two axes of the time and the frequency are defined.

In the independent low-rank matrix analysis, a probability distribution followed by the sound source is modeled under the following condition (processing S1002). That is to say, (A) the sound sources are independent of one another. (B) The time-frequency components of each of the sound sources follow a complex normal distribution. (C) The variances of the normal distributions are low-rank factorized by using NMF.

Processing S1003 to processing S1005 are optimization processing of parameters of NMF and the separation filter. In the processing S1003, the parameters of NMF are estimated. In the processing S1004, the separation filter is estimated so that the sound source vectors become independent of one another with the estimated parameters of NMF. This processing is repetitively executed by the predetermined number of times. As a concrete example, there is the estimation by an auxiliary function method disclosed in JP-2014-41308-A. In the processing S1005, the parameters and the separation filter converge or are ended in updating of the predetermined number of times, thereby completing the setting of the parameters.

In processing S1006, the set parameters and the separation filter are applied to the observed signals, and the signal in the time-frequency domain after the sound source separation is transformed into the signal in the time domain and the resulting signal is outputted.

As previously stated, one of the problems of the independent low-rank matrix analysis is that the strong correlation among the neighborhood frequencies cannot be grasped. In addition, the probability distribution followed by the sound source assumed by the independent low-rank matrix analysis is a complex normal distribution of a time variation. Thus, the probability distribution concerned involved a problem that the sound source separation performance is low for the audio signal or the like having a large kurtosis. In the example, an example is depicted in which this problem is taken into consideration.

Figure 2:
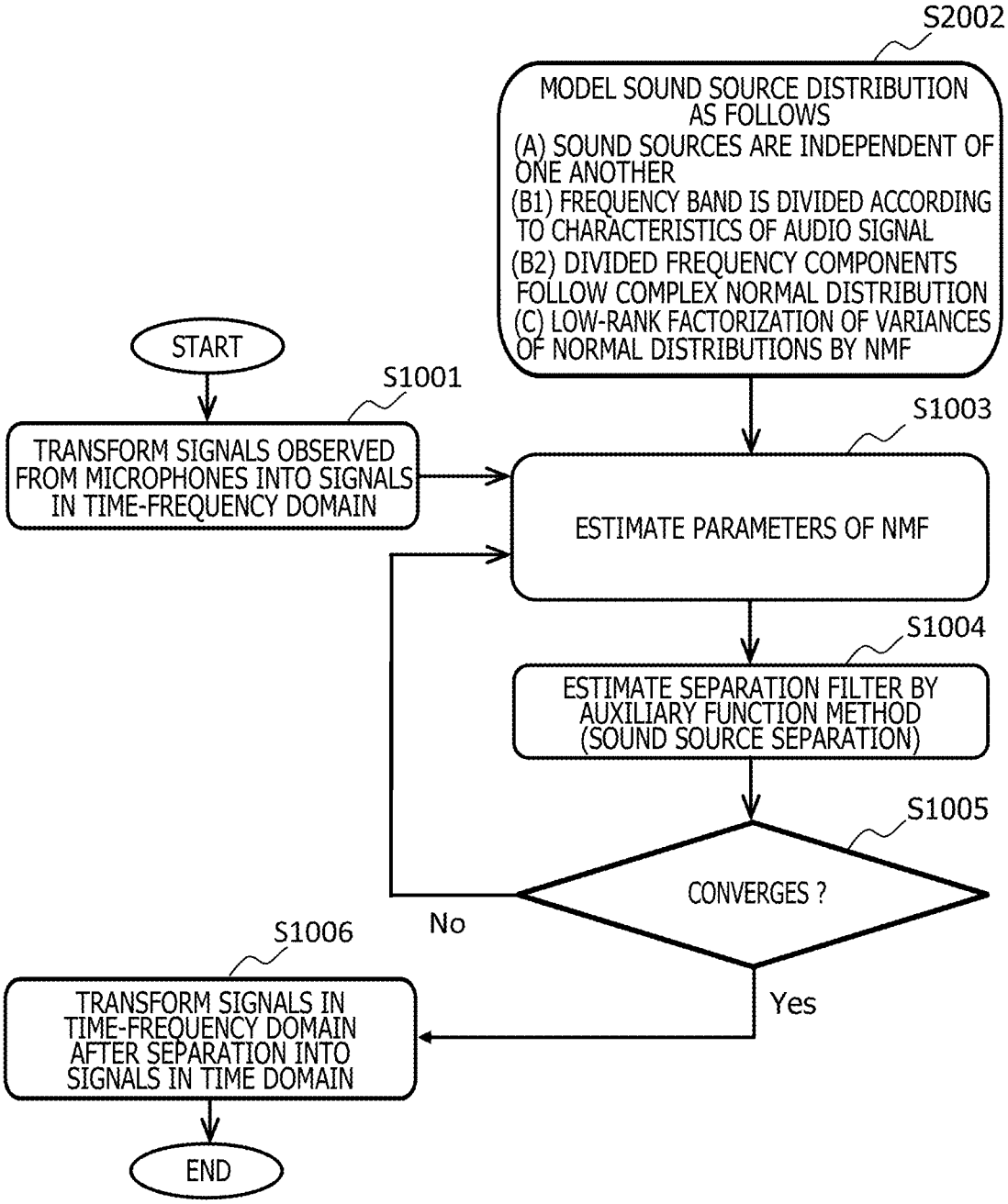
FIG. 2 is a conceptual flow chart of a basic example.

FIG. 2 is a conceptual flow chart of a basic example of the present invention. The modeling in the processing S2002 is given the characteristics. That is to say, (A) the sound sources are independent of one another. (B1) The frequency band is divided into components according to the characteristics of the audio signal. (B2) The components into which the sound sources are divided follow the complex normal distribution. (C) The variances of the normal distributions are low-rank factorized by using NMF. From the characteristics of (B1) and (B2), the strong correlation among the neighborhood frequencies of the audio signal can be grasped. In addition, since the number of parameters of NMF can be reduced, the processing for the optimization (sound source separation) is readily executed.

Figure 3:
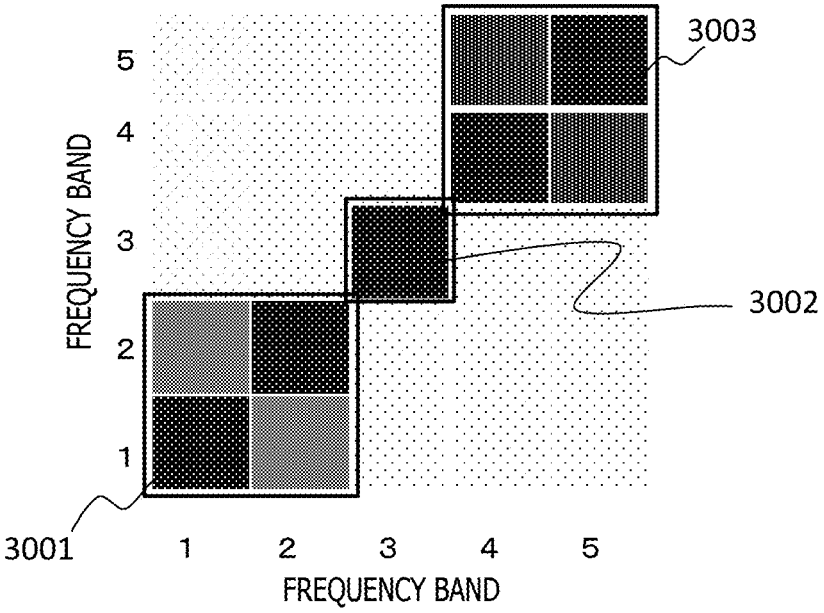
FIG. 3 is a conceptual diagram of processing of dividing a frequency band according to characteristics of an audio signal.

FIG. 3 is a diagram depicting the concept of the processing for dividing the frequency band of (B1) into the components according to the characteristics of the audio signal. Each of an axis of ordinate, and an axis of abscissa represents the frequency band (unit is kHz). In FIG. 3, a portion in which the color is deep depicts that the correlation is high. In this example, portions each having the high correlation are collectively divided like a region 3001, a region 3002, and a region 3003 in the frequency band, resulting in that the frequency bands having the similar characteristics can be extracted to be modeled.

For example, if it is assumed that the band of the sound obtained from the sound source by a microphone 191 is in the range of 20 Hz to 20 kHz, for the division of the frequency band, for example, the range having the strong correlation can be divided into the bands which are free in size like (band 1) 20 Hz to 100 Hz, (band 2) 100 Hz to 1 kHz, and (band 3) 1 kHz to 20 kHz. At this time, it is desirable that when the bands obtained through the division are summed up, the resulting band covers all the supposed frequency bands of the sound source.

Figure 4:
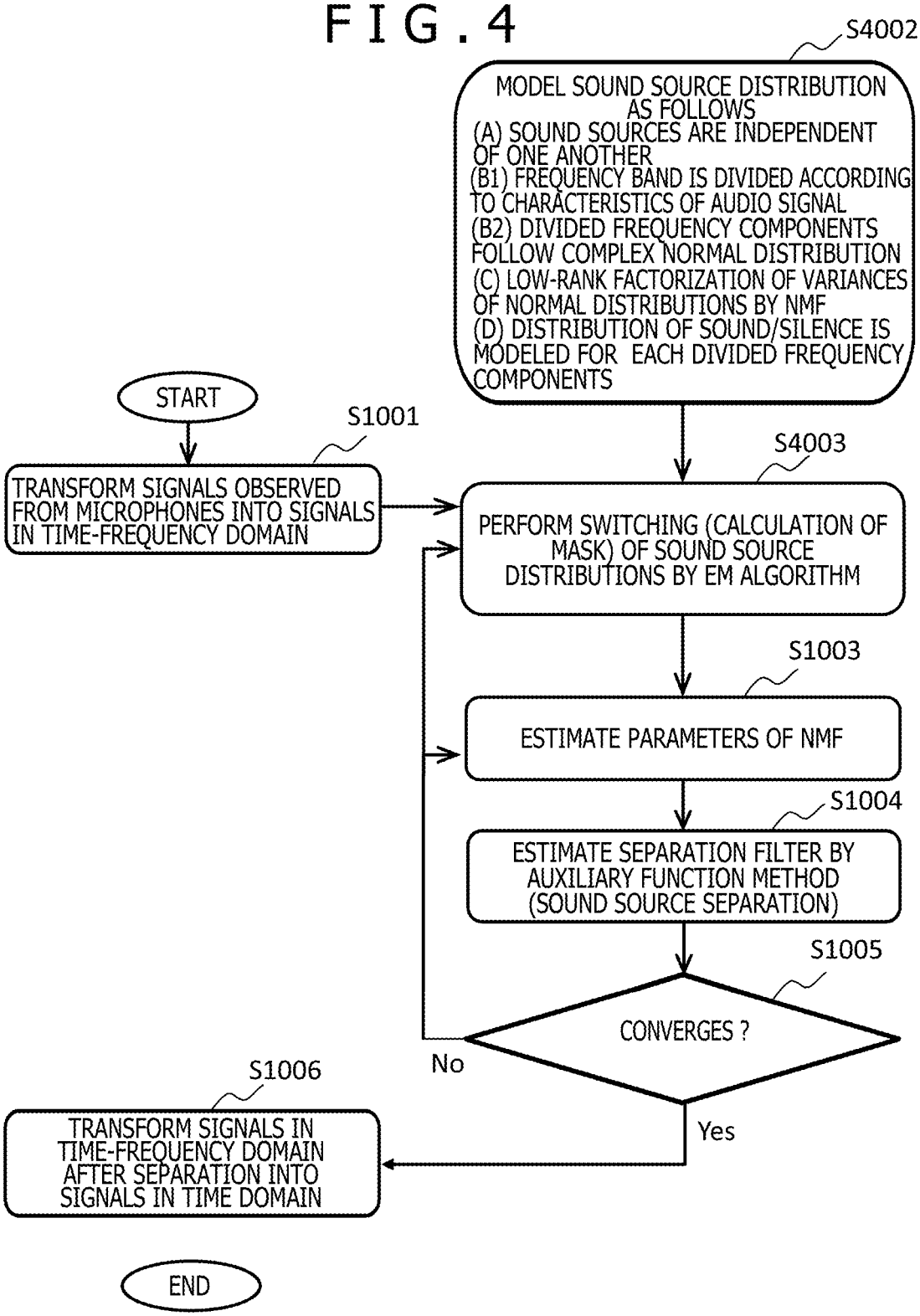
FIG. 4 is a conceptual flow chart of a developmental example.

FIG. 4 is a conceptual flow chart of a developmental example of the present invention. In the modeling processing S4002 of the example of FIG. 4, in addition to the condition of the modeling processing S2002 of the example of FIG. 2, (D) the probability distributions of the sound and the silence are separately molded for each divided frequency components. Here, the sound and the silence mean presence and absence of the sound (for example, utterance by a human being) from the focused specific sound source.

The past independent low-rank matrix analysis does not utilize the information that the sound sources follow the different probability distributions between the sound section and the silence section. Therefore, in the actual environment in which the sound sources are exchanged over to each other in terms of the time, the past independent low-rank matrix analysis has the insufficient sound source separation performance. Processing S4003 of FIG. 4, for example, for the probability distribution of the sound source, the model for the sound in which the sound is contained, and the model for the silence in which no sound is contained are switched over to each other to be applied, thereby enabling a sound source separation method having the high separation performance to be provided for the signal in which the sound section and the silence section are changed in an unsteady state manner. As a concrete algorithm for the model switching in this case, there is known an Expectation-Maximization (EM) Algorithm which will be described later.

In addition, it is desirable that in the modeling adopted in the processing described above, a modeling error is corrected. In this case, the modeling error can be corrected by a machine-leaning technique such as a Deep Neural network (DNN). Then, in two pieces of processing S4003 and S1003, it is considered that by using a plurality of, preferably, a large number of sound sources which are previously recorded and collected, DNN is made to carry out previous learning, and the modeling error of the probability distribution of the sound sources is corrected by DNN. With this configuration, the improvement in the sound source separation performance can be expected.

In the following example, a description will be given with respect to an example, as a concrete example, in which a probability model of the separation target signals, and a process for producing observed signals are modeled by using the frequency band division and the distribution information such as the kurtosis of the separation target signals, and the discrimination of the sound source state and the sound source separation are simultaneously selected, thereby carrying out the correction by using the neural network which previously learns the estimation result of the sound source state. Prior to a concrete description given with respect to embodiments of the present invention, a description will now be given with respect to a model for producing the observed signals in this example. In addition, symbols for describing this example will be defined.

<Observation Model>

It is assumed that the number of sound sources and the number of microphones are equal to each other, N. When the number of microphones is larger than the number of sound sources, it is only necessary to use the dimension reduction or the like. It is supposed that the time-series signals of the time domain generated from N sound sources are mixed with one another which are in turn observed by N microphones.

The sound source signal and the observed signal in the time frequency (f, t) are respectively expressed by Expression 1:

$$s_{f,t}=(s_{1,f,t}, \ldots, s_{N,f,t})^T$$

$$x_{f,t}=(x_{1,f,t}, \ldots, x_{N,f,t})^T \quad \text{(Expression 1)}$$

Then, the linear mixture expressed by Expression 2 is assumed:

$$x_{f,t}=A_f s_{f,t}$$

$$s_{f,t}=W_f^h x_{f,t} \quad \text{(Expression 2)}$$

where $f \in [N_F]$: $=\{1, \ldots, N_F\}$ is an index of the frequency, $t \in [N_T]$: $\{1, \ldots, N_T\}$ is an index of the time frame, and $A_f$ is a mixing matrix at the frequency f.

$$W_f[w_{1,f}, \ldots, w_{N,f}] \quad \text{(Expression 3)}$$

Expression 3 represents a separation matrix including a separation filter $W_{n,f}$ for the sound sources $n \in [N]$: $=\{1, \ldots, N\}$. In addition, $^T$ represents transpose of a vector, and $^h$ represents Hermitian transpose. With respect to the probability distribution followed by the sound sources, the following factorization expressed by Expression 4 is assumed:

$$p(\{s_{n,f,t}\}_{n\in[N],f\in[N_F],t\in[N_T]}) = \prod_{n\in[N]} \prod_{t\in[N_T]} p(\{s_{n,f,t}\}_{f\in[N_F]}) \quad \text{(Expression 4)}$$

For the purpose of expressing whether the sound sources $n \in [N]$ is in the sound state or in the silence state in the time frames $t \in [N_T]$, latent variables $\{Z_{n,t}\}_{n,t}$ expressed by Expression 5 are introduced:

$$Z_{n,t} = \begin{cases} 1 \text{ if in the sound state} \\ 0 \text{ if in the silence state} \end{cases} \quad \text{(Expression 5)}$$

When the latent variables $\{Z_{n,t}\}_{n,t}$ are used, the probability distribution of the sound sources $n \in [N]$ is expressed by Expression 6.

$$p(\{s_{n,f,t}\}_{f\in[N_F]}) = \sum_{c\in\{0,1\}} \pi_{n,t,c} \cdot p(\{s_{n,f,t}\}_{f\in[N_F]} \mid z_{n,t} = c) \quad \text{(Expression 6)}$$

Here, Expression 7 is defined as follows:

$$\pi_{n,t,c} := p(z_{n,t}=c) \quad \text{(Expression 7)}$$

The introduction of the latent variables $\{Z_{n,t}\}_{n,t}$ results in that in the sound source separation method of this example, the shape of the distribution can be switched over to another one in response to the state (the sound state or the silence state) of the sound source.

In this example, a Dirichlet prior probability distribution is assumed for $\{\pi_{n,t,c}\}_c$. That is to say, Expression 8 is assumed:

$$p(\{\pi_{n,t,c}\}_c) \propto \prod_{c\in\{0,1\}} (\pi_{n,t,c})^{\phi_c - 1} \quad \text{(Expression 8)}$$

where $\Phi_c$ is a hyperparameter of the Dirichlet prior probability distribution.

Next, a description will be given with respect to the band division as a point of this example. A set family E giving the division of the frequency band $[N_F]$ is introduced:

$$E \subseteq 2^{[N_F]}; \sqcup_{F \in E} F = [N_F]. \quad \text{(Expression 9)}$$

where a symbol similar to U represents a direct sum. This set family E will be referred to as a band division. It is assumed that the probability distribution followed by the sound source $n \in [N]$ under the condition in which the state $Z_{n,t}$ of the sound source is given is factorized as depicted in Expression 10 by using the band division E:

$$p(\{s_{n,F,t}\}_{F \in E} \mid z_{n,t} = c) = \prod_{F \in E} p(s_{n,F,t} \mid z_{n,t} = c). \quad \text{(Expression 10)}$$

where $S_{n,F,t}$ is a vector in which $\{S_{n,f,t} | f \in F\}$ are arranged side by side.

For example, it can be read that in the past independent component analysis and independent low-rank matrix analysis, Expression 11 is assumed in terms of the band division:

$$E = \{\{f\} | f \in [N_F]\} \quad \text{(Expression 11)}$$

In addition, it is read that in the past independent vector analysis, Expression 12 is assumed in terms of the band division:

$$E = \{[N_F]\} \quad \text{(Expression 12)}$$

As described with reference to FIG. 3, according to the band division of this example, the band division E suitable for the signal becoming the target of the sound source separation is set, thereby enabling the strong high-order correlation between the frequencies in the frequency band $F \in E$ to be explicitly modeled.

A complex-valued multivariate exponential power distribution, for example, can be used as the distribution which is followed by $S_{n,F,t}$ when the state $Z_{n,t}$ of the sound source is given.

$$p(s_{n,F,t} \mid z_{n,t} = c) = \frac{\Gamma(1 + |F|)}{(\pi \alpha_{n,F,t,c})^{|F|} \cdot \Gamma\left(1 + \frac{|F|}{\beta_c}\right)} \cdot \exp\left\{-\left(\frac{\|s_{n,F,t}\|^2}{\alpha_{n,F,t,c}}\right)^{\beta_c}\right\} \quad \text{(Expression 13)}$$

where $\Gamma(\bullet)$ is a gamma function, $|F|$ is a concentration of a set $F \in E$, $\|\bullet\|$ is $L^2$ norm, and $\alpha_{n,f,t,c} \in R_{>0}$ and $\beta_c \in R_{>0}$ are parameters of the multivariate exponential power distributions. However, $R_{>0}$ is a set composed of the entire positive real members.

When $\beta_c = 1$, the multivariate exponential power distribution Expression 13 agrees with a multivariate complex normal distribution. On the other hand, when $\beta_c < 1$, the multivariate exponential power distribution has a larger kurtosis than that of the multivariate complex normal distribution. In such a manner, in the sound source separation method in this example, even when the signal becoming the target of the sound source separation has the large kurtosis, adjustment of $\beta_c$ enables the sound source to be suitably modeled.

When the sound source is in the silence state, that is, when $Z_{n,t,c} = 0$, by using small $\varepsilon > 0$, Expression 14 is defined as follows:

$$\alpha_{n,F,t,0} = \varepsilon \text{ for all } n \in [N], F \in E, t \in [N_T] \quad \text{(Expression 14)}$$

Expression 14 models that when the sound source is in the silence state, $S_{n,F,t}$ is approximately 0.

On the other hand, when the sound source is in the sound state, that is, when $Z_{n,t,c} = 1$, $\{\alpha_{n,F,t,1}\}_{n,F,t}$ shall be modeled by using the nonnegative matrix factorization (NMF) as expressed by Expression 15:

$$\alpha_{n,F,t,1} = \sum_{k=1}^{K_n} u_{n,F,k} v_{n,k,t} \text{ for all } n \in [N], F \in E, t \in [N_T] \quad \text{(Expression 15)}$$

where $K_n$ represents the number of bases of NMF for the sound source $n \in [N]$. In addition, $\{U_{n,F,k}\}_F$ is the k-th base of the sound source $n \in [N]$, and $\{v_{n,k,t}\}_t$ represents the activation for the k-th base of the sound source $n \in [N]$.

In addition, as expressed in Expression 16, in the modeling by the NMF of $\{\alpha_{n,F,t,1}\}_{n,F,t}$, instead of fixing the number $K_n$ of bases for the sound sources $n \in [N]$, the number K of bases of the entire audio sound sources is given, and the bases can also be automatically allocated to the sound sources $n \in [N]$ by using the latent variables $\{y_{n,k}\}_{n,k}$.

$$\alpha_{n,F,t,1} = \sum_{K=1}^{K} y_{n,k} u_{F,k} v_{k,t}. \quad \text{(Expression 16)}$$

Here, it is supposed that the latent variable $\{y_{n,k}\}_{n,k}$ fulfill Expression 17, $$y_{n,k} \in \{0, 1\} \text{ and } \sum_n y_{n,k} = 1 \text{ for all } n \in [N] \text{ and } k \in [K] \quad \text{(Expression 17)}$$

or Expression 18:

$$0 \le y_{n,k} \le 1 \text{ and } \sum_n y_{n,k} = 1 \text{ for all } n \in [N] \text{ and } k \in [K] \quad \text{(Expression 18)}$$

The foregoing is the description given with respect to the production model of the observed signal in a first embodiment and a second embodiment of the sound source separation apparatus of this example. In this example, a set of a model parameter $\Theta$ is expressed by Expression 19, $$\Theta = \{W_f, u_{n,F,k}, v_{n,k,t}, \pi_{n,t,c}\}_{n,f,F,t,c,k} \quad \text{(Expression 19)}$$

or Expression 20:

$$\Theta = \{W_f, u_{n,k}, u_{F,k}, v_{k,t}, \pi_{n,t,c}\}_{n,f,F,t,c,k} \quad \text{(Expression 20)}$$

The estimation of the model parameters $\Theta$, for example, can be carried out based on the next maximum criteria of the posterior probability:

$$\min_{\Theta} j(\Theta) := -\frac{1}{N_T} \sum_{n,t} \log p(\{s_{n,F,t}\}_F) - 2\sum_f \log|\det W_f| - \sum_{n,t} \log p(\{\pi_{n,t,c}\}_c) \quad \text{(Expression 21)}$$

Although in the description of the embodiments, a method of carrying out the maximization of $J(\Theta)$ by using the known EM algorithm is described, existing any optimization algorithm can also be used. In the following, the embodiments of the present invention will be described with reference to the accompanying drawings.

First Embodiment

Figure 5:
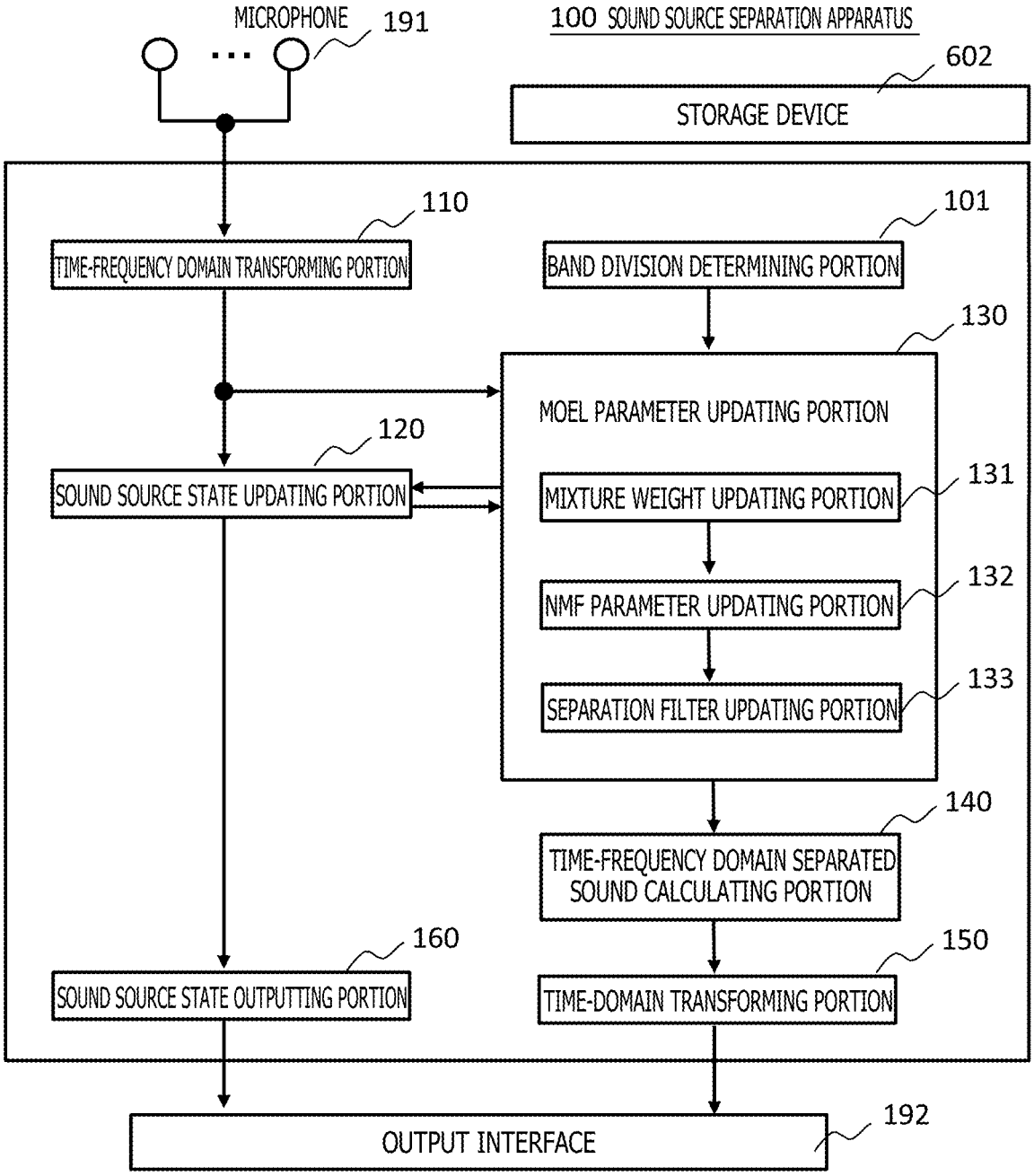
FIG. 5 is a block diagram exemplifying a functional configuration of a sound source separation apparatus according to a first embodiment of the present invention.

A sound source separation apparatus 100 according to the first embodiment of the present invention will be described with respect to FIGS. 5 to 7. FIG. 5 is a block diagram exemplifying a functional configuration of the sound source separation apparatus according to the first embodiment of the present invention. The sound source separation apparatus 100 is provided with a band division determining portion 101, a time-frequency domain transforming portion 110, a sound source state updating portion 120, a model parameter updating portion 130, a time-frequency domain separated sound calculating portion 140, a time domain transforming portion 150, and a sound source state outputting portion 160. Here, the model parameter updating portion 130 is configured to include a mixture weight updating portion 131, an NMF parameter updating portion 132, and a separation filter updating portion 133.

Figure 6:
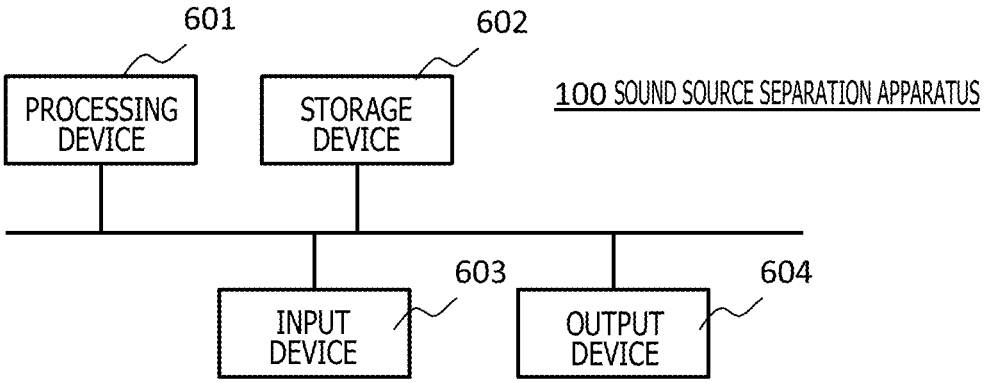
FIG. 6 is a block diagram of hardware of an example.

FIG. 6 is a block diagram depicting a hardware configuration of the sound source separation apparatus 100 of the first embodiment. In the first embodiment, the sound source separation apparatus 100 is configured to include a general server provided with a processing device 601, a storage device 602, an input device 603, and an output device 604. A program stored in the storage device 602 is executed by the processing device 601, whereby for the functions such as calculation and control, decided processing depicted in FIG. 5 and FIG. 7 is realized in conjunction with other hardware. A program to be exerted, a function thereof, or means for realizing the function thereof is referred to as "function," "means," "portion," "unit," "module" or the like in some cases.

A microphone 191 depicted in FIG. 5 configures a part of the input device 603 together with a keyboard, a mouse or the like. The storage device 602 stores therein data and a program necessary for the processing in the processing device 601. An output interface 192 outputs the processing result to another storage device, or a printer or a display device as the output device 604.

Figure 7:
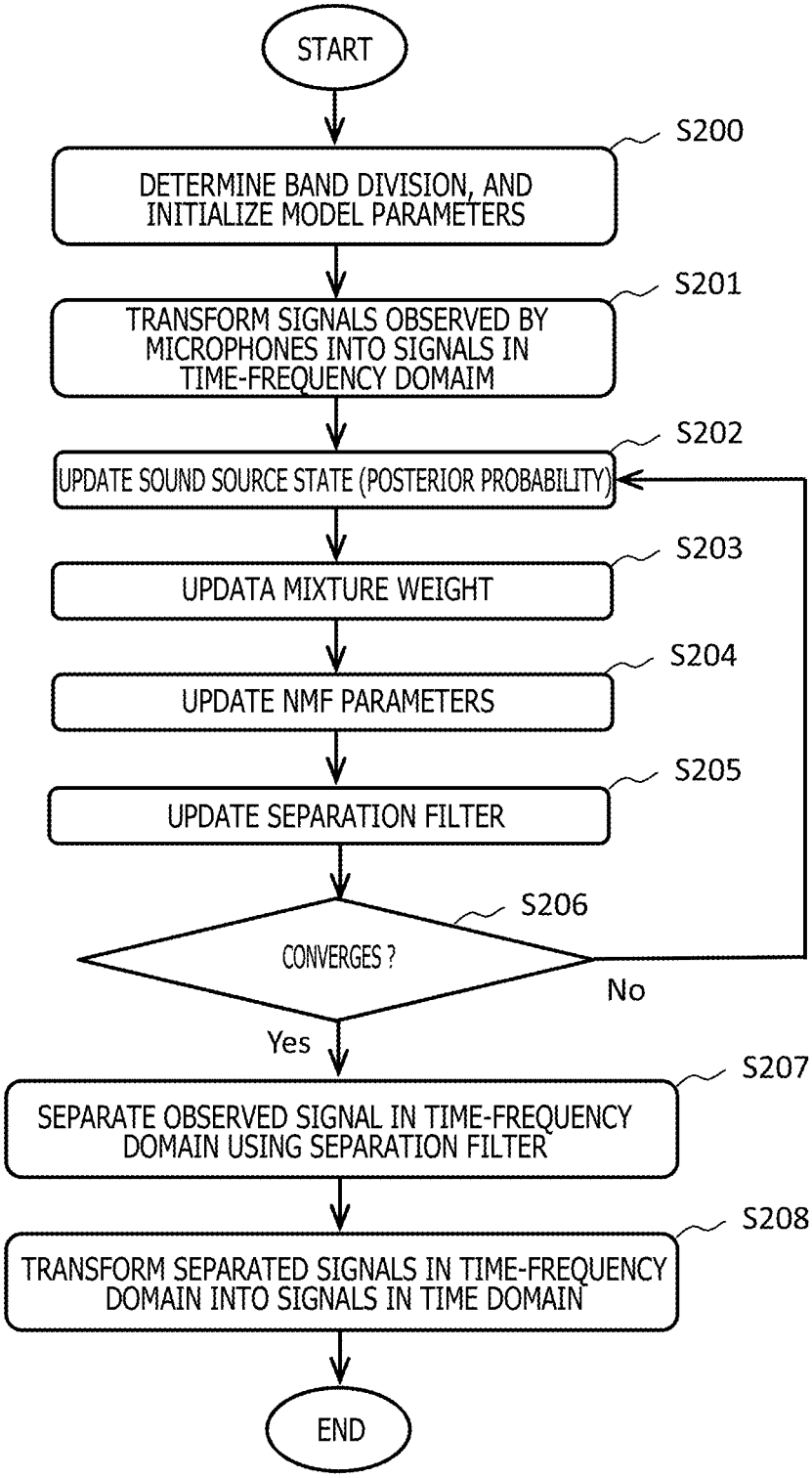
FIG. 7 is a flow chart exemplifying a processing flow of the sound source separation apparatus according to the first embodiment of the present invention.

FIG. 7 is a flow chart exemplifying a processing flow of the sound source separation apparatus according to the first embodiment. An example of an operation of the sound source separation apparatus 100 will now be described with reference to FIG. 7. However, with respect to the production model of the observed signal and the definition of the symbols in the production model, the contents stated in <Observation Model> are used without otherwise noted. In the sound source separation, with regard to the assumed sound sources, what probability distribution the sound sources follow is modeled, thereby carrying out the sound source separation.

In the following, with regard to the base of NMF in <Observation Model>, a description will now be given only with respect to the model in which like Expression 16, the bases are automatically allocated to the sound sources by using the latent variables $\{y_{n,k}\}_{n,k}$. The model parameters $\Theta$ at this time are given by Expression 20. Although the details are omitted, even in case of Expression 15, entirely in the same manner, the sound source separation method can be derived.

The optimization problem of Expression 21, for example, is solved by using the generalized EM algorithm, thereby attaining the estimation of the model parameters $\Theta$. The latent variable in the generalized EM algorithm is $\{z_{n,t}\}_{n,t}$, and the perfect data is $\{X_{f,t}, Z_{n,t}\}_{n,f,t}$.

The portions of the sound source separation apparatus 100, in Step S200, initializes the model parameters. In addition, the band division determining portion 101, in Step S200, determines the band division E defined by Expression 9 based on the prior knowledge of the separation target signal. For example, the audio signal becoming the target of the sound source separation is previously recorded, the calculation of the correlation of the frequencies as depicted in FIG. 3 is carried out, and the frequency bands having the correlation a value of which is equal to or larger than a predetermined threshold value are automatically collected, thereby enabling the frequency band division suitable for the sound source separation to be determined. Or, a worker may manually set the regions for a plurality of kinds of sounds becoming the target of the sound source separation based on the display as depicted in FIG. 3.

It is thought that the correlation of the frequencies differs depending on the kinds (for example, a conversation, music, and within traffic jam) or the like of the sound source. Therefore, a plurality of patterns of the frequency band division can be supposed every kind of the sound source. That is to say, a plurality of patterns of the band division can be prepared depending on the kind of the sound source. The frequency band division patterns for the respective situations can be prepared based on the audio data previously recorded, for example, in a conference, music, and a station yard.

A plurality of patterns of the band division which is prepared in accordance with the method described above is recorded in the storage device 602, and when the sound source separation is actually carried out, can be selected depending on the target of the sound source separation. For example, the band division determining portion 101 may display the band division method which can be selected every supposed sound source as a conversation or music on the display device as the output device 604, and the user may select the band division method by using the input device 603.

The time-frequency domain transforming portion 110 calculates a time-frequency expression $\{X_{f,t}\}_{f,t}$ of a mixed signal observed by using the microphone through Short-time Fourier transform or the like, and outputs the resulting time-frequency expression $\{X_{f,t}\}_{f,t}$ (Step S201).

The sound source state updating portion 120 calculates a posterior probability $q_{n,t,c}$ that the states of the sound sources are $z_{n,t}=C\in\{0, 1\}$ for the sound sources $n\in[N]$ and the time frames $t\in[N_T]$ by using the time-frequency expression $\{X_{f,t}\}_{f,t}$ and the estimated values $\Theta'$ of the model parameters, and outputs the resulting posterior probability $q_{n,t,c}$ to the model parameter updating portion 130 (Step S202). In this case, the time-frequency expression $\{X_{f,t}\}_{f,t}$ of the observed signal is outputted by the time-frequency domain transforming portion 110. The estimated values $\Theta'$ of the model parameters are outputted by the model parameter updating portion 130 which will be described later. The processing in Step S202 corresponds to the processing in E Step of the generalized EM algorithm.

The posterior probability $\{q_{n,t,c}\}_{n,t,c}$ of the sound source state is calculated based on an update equation Expression 22:

$$q_{n,t,c} = \frac{\pi'_{n,t,c} \cdot p(\{s'_{n,F,t}\}_{F\in E} \mid z_{n,t} = c)}{\sum_{c\in[0,1]} \pi'_{n,t,c} \cdot p(\{s'_{n,F,t}\}_{F\in E} \mid z_{n,t} = c)} \quad \text{(Expression 22)}$$

Here, Expression 23 is established:

$$s'_{n,f,t}=(w'_{n,f})^h x_{f,t} \text{ for } f\in F\subset E$$

$$w'_{n,f}, \pi'_{n,t,c}\in\Theta' \quad \text{(Expression 23)}$$

The model parameter updating portion 130 updates the values of the model parameters Θ by using the time-frequency expression of the observed signal outputted from the time-frequency domain transforming portion 110, and the posterior probability $\{q_{n,t,c}\}_{n,t,c}$ of the sound source states outputted from the sound source state updating portion 120 (Step S203, Step S204, and Step S205).

The processing of Step S203, the processing of Step S204, and the processing of Step S205 correspond to the processing of M Step of the generalized EM algorithm, and as will be described below, are executed by the mixture weight updating portion 131, the NMF parameter updating portion 132, and the separation filter updating portion 133, respectively.

In the processing of M Step of the generalized EM algorithm, Q(Θ) giving an upper bound of a cost function J(Θ) in Expression 21 is calculated, and the minimization problem in next Expression 24 is solved.

$$\min_{\Theta} Q(\Theta) := \frac{1}{N_T}\sum_{n,F,t,c} q_{n,t,c}\cdot g_{n,F,t,c}(r_{n,F,t}) - 2\sum_f \log|\det W_f| - \sum_{n,t,c}(q_{n,t,c}+\phi_c-1)\log\pi_{n,t,c} \quad \text{(Expression 24)}$$

However, Expression 25 is put:

$$g_{n,F,t,c}(r_{n,F,t})=-\log p(s_{n,F,t}|z_{n,t}=c)$$

$$r_{n,F,t}=\|s_{n,F,t}\|^2 \quad \text{(Expression 25)}$$

In addition, in Q(Θ), a constant term is omitted. This $g_{n,F,t,c}$ is referred to as a contrast function in a sound source state c, or simply referred to as a contrast function.

For the purpose of deriving the optimization algorithm based on an auxiliary function, the contrast function g(r) shall fulfill the following two conditions (C1) and (C2):

(C1) g: $R_{>0}\rightarrow R$ continuous differential can be carried out.

(C2) g'(r)/r a positive value is usually taken, and monotonous non-increasing is exhibited.

Here, g'(r) represents a differential coefficient about r of g(r). The complex-valued multivariate exponential power distribution given by Expression 13, when $\beta_{n,c}\leq 1$, fulfills the above conditions (C1) and (C2).

When Expression 13, Expression 14, and Expression 16 are substituted for the first term of Q(Θ) in Expression 24, Expression 26 is obtained:

$$\frac{1}{N_T}\sum_{n,F,t}\left[q_{n,t,0}\cdot\left(\frac{r^2_{n,F,t}}{\varepsilon}\right)^{\beta_0} + q_{n,t,1}\cdot\left(\frac{r^2_{n,F,t}}{\sum_k y_{n,k}u_{F,k}v_{k,t}}\right)^{\beta_1} + q_{n,t,1}\cdot|F|\cdot\log\sum_k y_{n,k}u_{F,k}v_{k,t}\right] \quad \text{(Expression 26)}$$

However, a constant term is omitted.

The mixture weight updating portion 131 calculates $\pi_{n,t,c}$ giving a minimum value of the optimization problem (Expression 24), and outputs the resulting $\pi_{n,t,c}$ (Step S203). Specifically, the mixture weight updating portion 131 calculates Expression 27, and outputs the results:

$$\pi_{n,t,c} = \frac{q_{n,t,c}+\phi_c-1}{\sum_{c\in[0,1]}(q_{n,t,c}+\phi_c-1)} \quad \text{(Expression 27)}$$

The NMF parameter updating portion 132 updates the model parameters $\{y_{n,k}, U_{F,k}, v_{k,t}\}_{n,F,t,k}$ based on the optimization problem Expression 24 (Step S204). In this case, an update equation using the auxiliary function method is given.

Expression 28 can be derived as the auxiliary function $Q^+(\Theta)$ of Q(Θ) about the parameters $\{y_{n,k}, U_{F,k}, v_{k,t}\}_{n,F,t,k}$.

$$Q(\Theta) \leq Q^+(\Theta) = \frac{1}{N_T}\sum_{n,F,t,k} q_{n,t,1}\left[\lambda^{1+\beta_1}_{n,F,t,k}\left(\frac{r^2_{n,F,t}}{y_{n,k}u_{F,k}v_{k,t}}\right)^{\beta_1} + |F|\cdot\frac{y_{n,k}u_{F,k}v_{k,t}}{\mu_{n,F,t}}\right] + cc \quad \text{(Expression 28)}$$

In addition, an equal sign is established when Expression 29 is established, and is established on that particular occasion.

$$\lambda_{n,F,t,k} = \frac{y_{n,k}u_{F,k}v_{k,t}}{\sum_k y_{n,k}u_{F,k}v_{k,t}} \quad \text{(Expression 29)}$$

$$\mu_{n,F,k} = \sum_k y_{n,k}u_{F,k}v_{k,t}$$

In the auxiliary function method, "calculation of the auxiliary function $Q^+(\Theta)$" and "such parameter update as to minimize the auxiliary function $Q^+(\Theta)$" are alternately repeated, thereby minimizing the original objective function Q(Θ).

When the auxiliary function $Q^+(\Theta)$ is used, an update equation of the parameters $\{y_{n,k}\}_{n,k}$ is given as follows.

$$y_{n,k} \leftarrow y_{n,k}\left[\frac{\beta_1\sum_{F,t} q_{n,t,1}r^{2\beta_1}_{n,F,t}u_{F,k}v_{k,t}\left(\sum_k y_{n,k}u_{F,k}v_{k,t}\right)^{-1-\beta_1}}{\sum_{F,t} q_{n,t,1}u_{F,k}v_{k,t}|F|\left(\sum_k y_{n,k}u_{F,k}v_{k,t}\right)^{-1}}\right]^{\frac{1}{1+\beta_1}} \quad \text{(Expression 30)}$$

However, after the update is carried out in accordance with Expression 30, the update shall be carried out so as to fulfill $\Sigma_n y_{n,k}=1$ in accordance with Expression 31.

$$y_{n,k} \leftarrow \frac{y_{n,k}}{\sum_n y_{n,k}} \quad \text{(Expression 31)}$$

Alternatively, the update may be carried out as follows:

$$y_{n,k} = \begin{cases} 1 \text{ if } n = \operatorname{argmax}_{n'} y_{n',k} \\ 0 \text{ otherwise} \end{cases} \quad \text{(Expression 32)}$$

In addition, an update equation of the parameters $\{U_{F,k}, v_{k,t}\}_{F,k,t}$ is given as follows:

$$u_{F,k} \leftarrow u_{F,k}\left[\frac{\beta_1 \sum_{n,t} q_{n,t,1} r_{n,F,t}^{2\beta_1} y_{n,k} v_{k,t} \left(\sum_k y_{n,k} u_{F,k} v_{k,t}\right)^{-1-\beta_1}}{\sum_{n,t} q_{n,t,1} y_{n,k} v_{k,t} |F| \left(\sum_k y_{n,k} u_{F,k} v_{k,t}\right)^{-1}}\right]^{\frac{1}{1+\beta_1}} \quad \text{(Expression 33)}$$

$$v_{k,t} \leftarrow v_{k,t}\left[\frac{\beta_1 \sum_{n,F} q_{n,t,1} r_{n,F,t}^{2\beta_1} y_{n,k} u_{F,k} \left(\sum_k y_{n,k} u_{F,k} v_{k,t}\right)^{-1-\beta_1}}{\sum_{n,F} q_{n,t,1} y_{n,k} u_{F,k} |F| \left(\sum_k y_{n,k} u_{F,k} v_{k,t}\right)^{-1}}\right]^{\frac{1}{1+\beta_1}}$$

The separation filter updating portion 133 updates the separation filter $\{W_f\}$ based on the optimization problem Expression 24 (Step S205). In this case, the update equation using the auxiliary function method is given.

Expression 34 can be derived as the auxiliary function $Q^+_w(\Theta)$ of $Q(\Theta)$ about the parameters $\{W_f\}_f$.

$$Q(\Theta) \le Q_W^+(\Theta) = \sum_{n,f} w_{n,f}^h R_{n,f} w_{n,f} - 2\sum_f \log|\det W_f| + const. \quad \text{(Expression 34)}$$

Here, Expression 35 is put as follows:

$$R_{n,f} = \frac{1}{N_T}\sum_t [\phi(r'_{n,F,t}) x_{f,t} x_{f,t}^h] \text{ for } f \in F \quad \text{(Expression 35)}$$

$$\phi(r'_{n,F,t}) = \frac{\sum_{c\in\{0,1\}} q_{n,t,c} \cdot g'_c(r'_{n,F,t})}{2r'_{n,F,t}}$$

$$r'_{n,F,t} = \left(\sum_{f\in F} |(w'_{n,f})^h x_{f,t}|^2\right)^{\frac{1}{2}}$$

where $g'_c(r)$ is differential about r of $g_c(r)$.

When the auxiliary function $Q^+_w(\Theta)$ is used, an update equation of the separation filter $\{W_f\}_f$ is given as follows:

$$w_{n,f} \leftarrow (W_f^h R_{n,f})^{-1} e_n$$

$$W_{n,f} \leftarrow w_{n,f}(w_{n,f}^h R_{n,f} w_{n,f})^{-1/2} \quad \text{(Expression 36)}$$

The model parameter updating portion 130 outputs an estimation value of the model parameter which is obtained in the mixture weight updating portion 131, the NMF parameter updating portion 132, and the separation filter updating portion 133.

The pieces of processing from Step S202 to Step S205 are repetitively executed up to when the predetermined number of times of the update previously set by the user is reached, or until the values of the parameters converge in the model parameter updating portion 130 (Step S206). The maximum value of the number of times of repetitions can be set to 100 or the like. When the repetitive processing is ended, the model parameter updating portion 130 outputs the estimated separation filter $\{W_f\}_f$.

In addition, when the repetitive processing is ended and the parameters of the model are determined, the sound source state outputting portion 160 outputs the posterior probability $\{q_{n,t,c}\}_{n,t,c}$ of the sound source state obtained in the sound source state updating portion 120. The posterior probability is used, resulting in that only the sound sections of the sound sources can be extracted. That is to say, the sound source separation apparatus 100 of the first embodiment is an apparatus which can simultaneously solve the sound source separation and the estimation of the sound source state.

Next, the time-frequency domain separated sound calculating portion 140 will be described below. The time-frequency domain separated sound calculating portion 140 calculates separated signals $s_n(f, t)$ of the sound source $n \in [N]$ in the time-frequency domains (f, t) by using the time-frequency expression $\{X_{f,t}\}_{f,t}$ of the observed signal outputted by the time-frequency domain transforming portion 110, and the separation filter $\{W_f\}_f$ outputted by the model parameter updating portion 130, and outputs the resulting separated signals $s_n(f, t)$ (Step S207).

The time domain transforming portion 150 transforms the separated signals $s_n(f, t)$ in the time-frequency domain into the separation signal in the time domain for the sound source $n \in [N]$, and outputs the resulting separation signals (Step S208).

Second Embodiment

Figure 8:
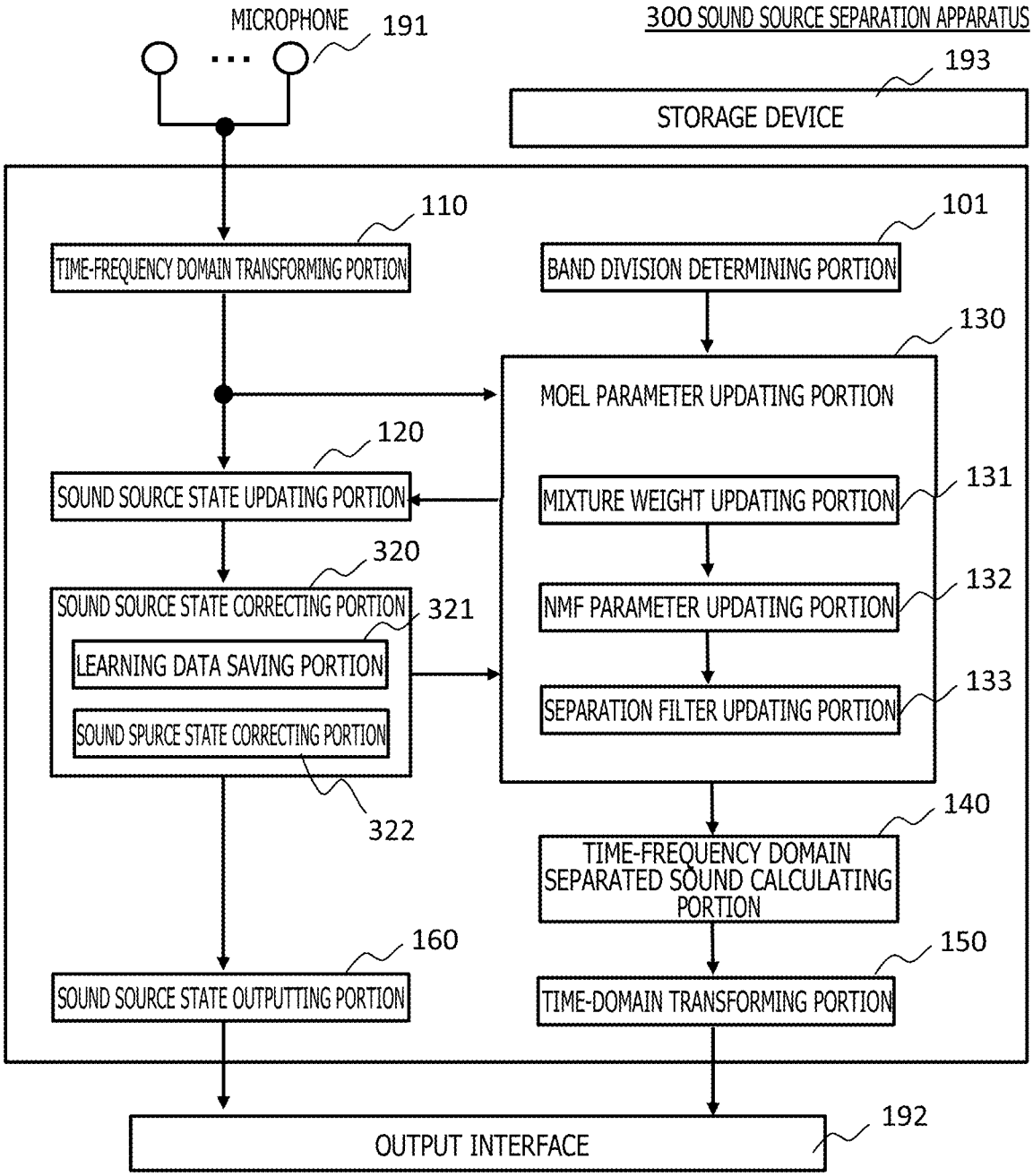
FIG. 8 is a block diagram exemplifying a functional configuration of a sound source separation apparatus according to a second embodiment of the present invention.

A sound source separation apparatus 300 according to the second embodiment of the present invention will now be described with reference to FIGS. 8 and 9. The sound source separation apparatus 300 of the second embodiment has the same configuration as that of the sound source separation apparatus 100 of the first embodiment depicted in FIG. 5 except that a sound source state correcting portion 320 in FIG. 8 is added. Therefore, in the following, only the sound source state correcting portion 320 will be described, and a description of any of other portions is omitted here.

Figure 9:
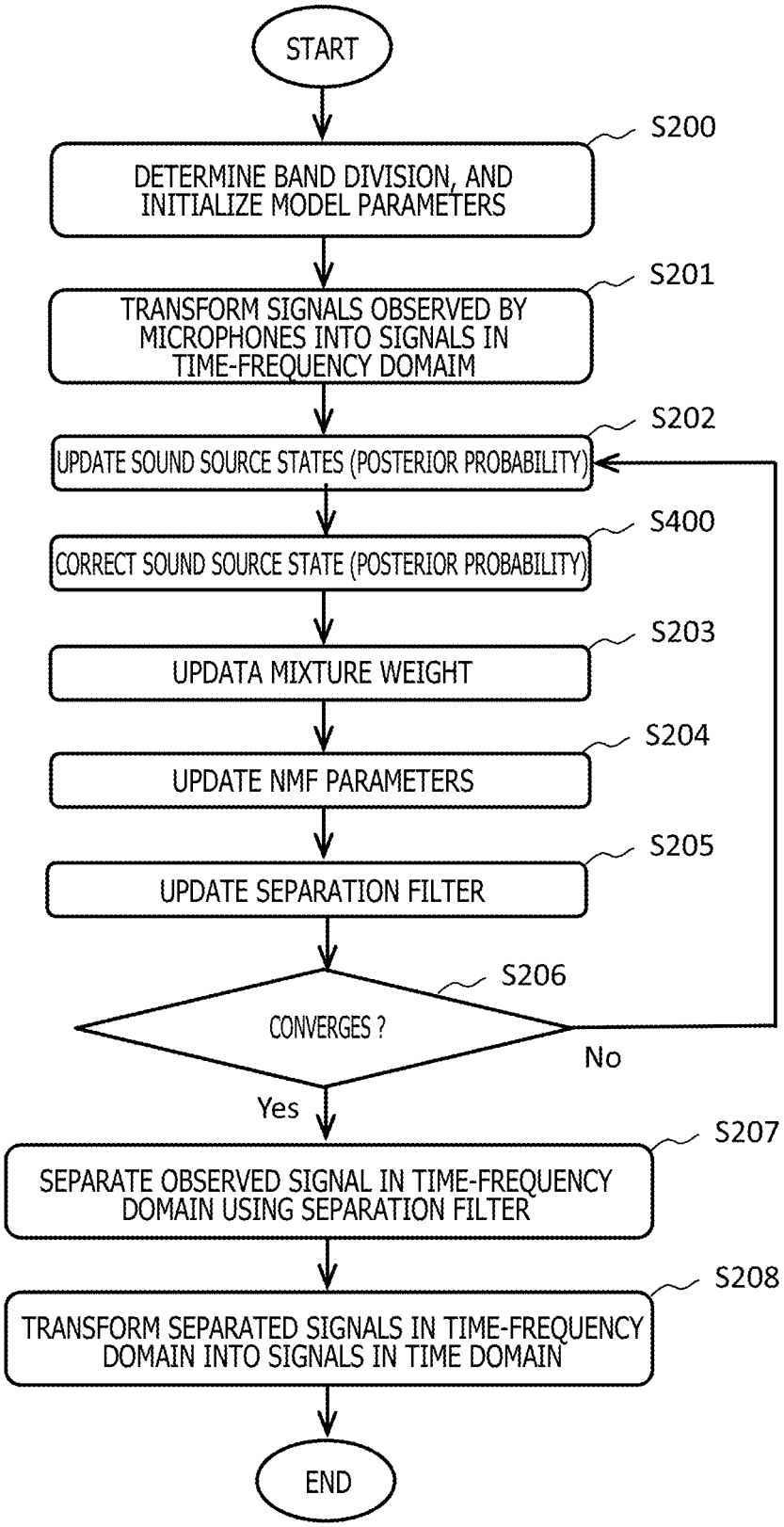
FIG. 9 is a flow chart exemplifying a processing flow of the sound source separation apparatus according to the second embodiment of the present invention.

In addition, a processing flow of the second embodiment depicted in FIG. 9 is also the same as that of the first embodiment depicted in FIG. 7 except that correction (Step S400) of the sound source state (posterior probability) is added. Therefore, in the following, only the correction (Step S400) of the sound source state (posterior probability) will be described, and a description of any of other portions is omitted here.

The sound source state correcting portion 320 is composed of a learning data saving portion 321 and a sound source state correcting portion 322. The sound source state correcting portion 320 previously learns a neural network for correcting the posterior probability $\{q_{n,t,c}\}_{n,t,c}$ of the sound source state expressed by Expression 22 by using the signal data preserved in the learning data saving portion 321, and preserves the learned neural network.

As far as a method of learning the neural network, when a true value of the sound source state is expressed by Expression 37, $$\{\hat{q}_{n,t,c}\}_{n,t,c} \quad \text{(Expression 37)}$$

$$\{\hat{q}_{n,t,c}\}_{n,t,c} \cong f(\{q_{n,t,c}\}_{n,t,c}) \quad \text{(Expression 38)}$$

it is only necessary that such mapping f as to fulfill Expression 38 is modeled by the neural network, and the mapping f is learned by using the learning data.

The sound source state correcting portion 322 calculates a correction value $\{q'_{n,t,c}\}_{u,t,c}$ of the posterior probability $\{q_{n,t,c}\}_{u,t,c}$ of the sound source state outputted from the sound source state updating portion 120 by using the neural network preserved in the sound source state correcting portion 320, and outputs the resulting correction value $\{q'_{n,t,c}\}_{u,t,c}$ to the model parameter updating portion 130 (Step S400).

When the repetition processing is ended in Step S206, the sound source state outputting portion 160 outputs the correction value $\{q'_{n,t,c}\}_{u,t,c}$ of the posterior probability of the sound source state obtained in the sound source state correcting portion 320.

Although the details are omitted here, instead of the posterior probability $\{q_{n,t,c}\}_{u,t,c}$ of the sound source state, the mixture weight $\{\pi_{n,t,c}\}_{n,t,c}$ as the prior probability of the sound source state may be corrected by using the learned network.

<Program and Storage Media>

In the case where the sound source separation apparatus of each of the embodiments is realized by a computer, the functions which the devices have, is described by a program. Then a predetermined program is read in the computer, for example, configured to include read only memory (ROM), random access memory (RAM), central processing unit (CPU) and the like, and CPU executes the program, thereby realizing the sound source separation apparatus.

<Implementation in Robot, Signage or the Like>

The sound source separation apparatus of each of the embodiments can be implemented in an apparatus such as a robot or a signage, and any system cooperating with a server. According to each of the embodiments, the sound source separation method having the high separation performance can be provided for the signal having the complicated time-frequency structure which cannot be grasped by only the co-occurrence of the frequency components, for the signal a distribution shape of which is largely different from the complex normal distribution, or for the signal in which the sound section and the silence section are changed in an unsteady manner.

According to the embodiments of the present invention, the sound source separation method having the high separation performance can be provided for the signal having the complicated time-frequency structure which cannot be grasped by only the co-occurrence of the frequency components.

The present invention is by no means limited to the embodiments described above, and includes various modified changes. For example, a part of the constitution of a certain embodiment can be replaced with a constitution of any other embodiment. In addition, a constitution of any other embodiment can be added to a constitution of a certain embodiment. In addition, with respect to a part of the constitutions of the embodiments, addition, deletion or replacement of a constitution of any other embodiment can be carried out.

What is claimed is:

1. A sound source separation method of carrying out sound source separation of an audio signal inputted from an input device by using a modeled sound source distribution, by an information processing apparatus provided with a processing device, a storage device, the input device, and an output device, wherein as a condition followed by the model, sound sources are independent of one another, powers which the sound sources have, respectively, are modeled for each of frequency bands obtained through band division based on a correlation among frequencies, a relationship among the powers for the frequency bands different from each other is modeled by nonnegative matrix factorization, and components obtained through division of the sound source follow a complex normal distribution.

2. The sound source separation method according to claim 1, wherein the powers which the sound sources have are modeled for each of the frequency bands obtained through the band division in accordance with a method responding to an inputted audio signal.

3. The sound source separation method according to claim 2, wherein a plurality of kinds of band division methods are prepared and stored in the storage device, and when the sound source separation of the audio signal is carried out, one of the plurality of kinds of band division methods is selected by an input from the input device.

4. The sound source separation method according to claim 1, wherein a distribution of the components obtained through the division of the sound source follows a multivariate exponential power distribution.

5. The sound source separation method according to claim 1, wherein a probability distribution of the sound source is switched in response to a state of the sound source.

6. The sound source separation method according to claim 5, wherein in order to express whether the sound source is in a sound state or in a silence state, the probability distribution of the sound source is expressed by introducing a latent variable taking binary.

7. The sound source separation method according to claim 1, wherein at least one estimated value of a prior probability and a posterior probability of a sound source state is corrected by using a deep neural network in repetitions of optimization.

8. A sound source separation apparatus provided with a processing device, a storage device, an input device, and an output device, the sound source separation apparatus serving to carry out sound source separation of an audio signal inputted from the input device by using a modeled sound source distribution, wherein as a condition followed by the model, sound sources are independent of one another, powers which the sound sources have, respectively, are modeled for each of frequency bands obtained through band division based on a correlation among frequencies, a relationship among the powers for the frequency bands different from each other is modeled by nonnegative matrix factorization, and components obtained through division of the sound source follow a complex normal distribution.

9. The sound source separation apparatus according to claim 8, further comprising:

a band division determining portion for displaying a plurality of kinds of selectable band division methods on the output device, one of the band division methods being made selectable by the input device.

10. The sound source separation apparatus according to claim 9, further comprising:

a model parameter updating portion for updating parameters of the model by using the band division method, and time-frequency expression of the audio signal inputted from the input device; and a sound source state updating portion for calculating a posterior probability expressing a state of the sound source by using the time-frequency expression of the audio signal inputted from the input device, and the parameters of the model outputted from the model parameter updating portion.

11. The sound source separation apparatus according to claim 10, wherein the model parameter updating portion updates the parameters of the model by using the posterior probability as well outputted by the sound source state updating portion.

12. The sound source separation apparatus according to claim 11, further comprising a sound source state outputting portion for, when repetition processing of the model parameter updating portion is ended, outputting the posterior probability calculated in the sound source state updating portion.

13. A sound source separation method of carrying out sound source separation of an audio signal inputted from an input device by using a modeled sound source distribution, by an information processing apparatus provided with a processing device, a storage device, the input device, and an output device, wherein as a condition followed by the model, sound sources are independent of one another, powers which the sound sources have are modeled for each of frequency bands obtained through band division, a relationship among the powers for the frequency bands different from each other is modeled by nonnegative matrix factorization, components obtained through division of the sound source follow a complex normal distribution, and a probability distribution of the sound source is switched in response to a state of the sound source.

14. The sound source separation method according to claim 13, wherein in order to express whether the sound source is in a sound state or in a silence state, the probability distribution of the sound source is expressed by introducing a latent variable taking binary.

* * * * *